United States Patent [19]

Lawrence

[11] Patent Number: 4,813,556

[45] Date of Patent: Mar. 21, 1989

[54] COLLAPSIBLE BABY BOTTLE WITH INTEGRAL GRIPPING ELEMENTS AND LINER

[75] Inventor: Gary D. Lawrence, Fort Worth, Tex.

[73] Assignee: Globestar Incorporated, Fort Worth, Tex.

[21] Appl. No.: 117,910

[22] Filed: Nov. 3, 1987

Related U.S. Application Data

[63] Continuation-in-part of Ser. No. 884,488, Jul. 11, 1986, abandoned.

[51] Int. Cl.[4] ..... A61J 9/00; A61J 9/08; B65D 23/02; B65D 23/10

[52] U.S. Cl. ..... 215/11.3; 215/11.1; 215/100 A; 215/11.6; 220/94 A; 220/470; 383/907

[58] Field of Search ..... 215/11.1–11.6, 215/100 A, 1 R; 220/94 A, 470; 383/38, 904, 907; D9/301, 380, 382; D24/46, 47; 222/105, 95

[56] References Cited

U.S. PATENT DOCUMENTS

| | | | |
|---|---|---|---|
| 47,650 | 7/1915 | Roach | 215/1 R X |
| D. 248,827 | 8/1987 | Goldschmidt et al. | D 9/301 |
| 595,414 | 12/1897 | Roach | 215/11 R |
| 710,864 | 10/1902 | Hogan et al. | 383/38 X |
| 2,624,485 | 1/1953 | Boston | 215/11.5 |
| 2,793,778 | 5/1957 | Maxwell | 215/11 R |
| 3,009,498 | 11/1961 | Fohr | 383/904 X |
| 3,362,555 | 1/1968 | Soto | 215/11 E |
| 3,443,710 | 5/1969 | Hills | 215/100 A X |
| 3,467,269 | 9/1969 | Newton | 215/6 |
| 3,698,595 | 10/1972 | Gortz et al. | 222/105 X |
| 4,492,313 | 1/1985 | Touzani | 215/1 C |
| 4,570,808 | 2/1986 | Campbell et al. | 215/11 R |
| 4,637,934 | 1/1987 | White | 215/11 R X |
| 4,700,856 | 10/1987 | Campbell et al. | 215/100 A X |

FOREIGN PATENT DOCUMENTS

| | | | |
|---|---|---|---|
| 63033 | 10/1982 | European Pat. Off. | 215/11 E |
| 2109247 | 6/1983 | United Kingdom | 215/11 C |

*Primary Examiner*—Sue A. Weaver

*Attorney, Agent, or Firm*—Hubbard, Thurman, Turner & Tucker

[57] ABSTRACT

A baby bottle for use with or without a liner in a first embodiment has a container with a bellows shaped top portion with an open end, a body portion having a pair of spaced tubular handle forming members, and a bottom portion having a closed end. The bellows is compressible for removing air from the container when used without a liner or a liner when used. The body portions spaced tubular members having a size suitable for grasping by a baby's hand form a centrally located bottle opening; the opening between the tubular members forms with the shape of the bottle bottom portion a guide for guiding a baby's hands to the handles for self-feeding. The handles are in vertical alignment with the top and bottom portions to facilitate bottle cleaning and liner insertion. A disposable, bifurcated, resilient liner is provided with an insert means for inserting the liner's bifurcated portions through the top portion to fit corresponding portions in the handles, and the bottom portion. In a second embodiment, the body portion tubular surface has opposing recesses for forming adjacent surfaces into handles sized to accommodate the hands of a baby for self-feeding. The handles together with the open space between the recesses form a single passage in open communication with the container's top and bottom portions for facilitating cleaning and sterilization and insertion of a liner when used.

13 Claims, 4 Drawing Sheets

COLLAPSIBLE BABY BOTTLE WITH INTEGRAL GRIPPING ELEMENTS AND LINER

This application is a continuation-in-part of patent application Ser. No. 884,488, filed July 11, 1986, for a "Baby Bottle."

BACKGROUND OF THE INVENTION

This invention relates to baby bottles and more particularly to a baby bottle for use with or without a liner.

In the past baby bottles, such as those disclosed in U.S. Pat. No. 595,414 issued Dec. 14, 1897 to J. C. Roach and in U.S. Pat. No. 4,570,808 issued Feb. 18, 1986 to Campbell et al. have included at least one integral element forming a handle having a circumferential dimension sufficiently small for babies to grasp with their small hands for supporting the bottle during feeding. The handles of Roach and Campbel et al. are formed, respectively, by openings in the top and central bottle portions. The handles of Roach are of uniform dimensions; the handles of Campbell et al. have concave surfaces forming the smallest dimension at the centers of the handles. The purpose of the concave handle configuration is to assist in guiding the babies hands to and around the handles. Neither the Roach nor Campbell et al. baby bottles are designed for use with a liner.

Baby bottles using liners, such as those disclosed in U.S. Pat. No. 2,793,778 issued May 28, 1957 to K. B. Maxwell and European Patent Application No. 82301846.0 filed July 4, 1982 by Andrew David McFarlane, have features preventing their use without liners. For example, Maxwell teaches a bottle bottom having a centrally disposed air hole for admitting air to collapse the liner evenly as milk is taken from the liner. While, McFarlane teaches a liner type baby bottle having a screw cap at the bottom end.

The problem attending the use of either the Roach or Campbell et al. baby bottles with liners is that of liner insertion and developing a means for facilitating air removal from the liner. While, the problem with using the Maxwell and McFarlane baby bottles without liners is that of bottom leakage, cleaning, and air removal.

With the handles at the top portion of the bottle as in Roach or with the handles having concave surfaces at the body portion as in Campbell et al., the bottle's top opening and the handle openings are not substantially aligned for facilitating cleaning, liner insertion and filling the liner with milk.

With a hole in the bottom as in Maxwell or with a screw on bottom as in McFarlane the bottle is going to leak milk when used without a liner. To close the hole of Maxwell defeats the purpose of the hole when the bottle is used with a liner; while, to provide a non-leaking screw on bottom decreases the mean time before failure of the bottle and its efficiency, while increasing cost.

A significant feature of the invention is the inclusion of a bellows in a portion of a container which adapts the container for air removal when used with or without a liner. The container is configured in a first embodiment with opposing tubular handles in vertical alignment with the top and bottom portions of the container to facilitate cleaning and sterilization, and liner insertion when used, and in a second embodiment with handle forming recesses to accommodate holding by an infant using at least one hand and to facilitate cleaning, sterilization and when used with a liner, liner insertion.

SUMMARY OF THE INVENTION

Accordingly, it is an object of the present invention to provide a baby bottle for use with or without a liner.

Another object of the invention is to provide a baby bottle for use with or without a liner which is easy to clean.

Still another object of the invention is to provide a baby bottle for use with or without a liner which is easy to grasp by the baby for holding while feeding.

Yet, another object of the invention is to provide a baby bottle which is efficient and inexpensive for use either with or without a liner.

A further object of the invention is to provide a baby bottle for use with or without a liner and which when used with a liner, the liner is easily insertable.

Still a further object of the invention is to provide a baby bottle for use with or without a liner which when used with a liner is capable of removing any trapped air from the liner.

Yet, still a further object of the invention is to provide a baby bottle for use with or without a liner having a collapsible container portion which is collapsible for air removal whether used with or without a liner, and bendable for facilitating use in feeding a baby.

Briefly stated the invention comprises a baby bottle for use with or without a liner. The bottle includes, in a first embodiment, a pair of centrally disposed tubular shaped handles in substantial alignment with the bottle's opening whereby the cleaning of the bottle is facilitated with either use, and insertion of the liner is facilitated when used with the liner. The centrally located tubular handles are provided for self-feed. A bellows forming surface is provided above the handles. The bellows is compressible to remove air from the bottle or a liner, if used, in the bottle. The bellows automatically locks in the compressed state to prevent expansion and air intake. The bellows surface may be bent in its locked position to facilitate self-feeding.

In a second embodiment the invention includes a tubular surface having entrally disposed opposing recesses for forming baby sized handles of the bottle surface beneath the bellows shaped surface portion. The handle forming surface portions of the tubularly shaped surface provide handles of sizes suitable for grasping by a baby's hands and the recesses between the handles include flared surface end zones adjacent to the top and bottom portions of the container for guiding the baby's hands into the recesses for grasping the handles to facilitate self-feeding practices.

BRIEF DESCRIPTION OF THE DRAWINGS

Other objects and features of the invention will become more readily understood from the following detailed description and appended claims when read in conjunction with the accompanying drawings in which:

DESCRIPTION OF THE PREFERRED EMBODIMENTS

Figure 1:
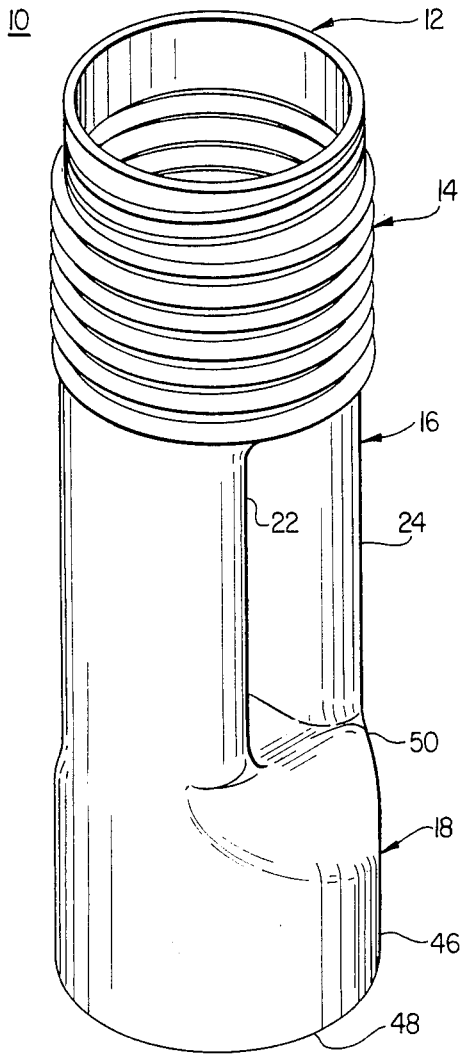
FIG. 1 is an isometric view of the baby bottle constituting the subject matter of a first embodiment of this invention.

The baby bottle 10 (FIG. 1) constituting the subject matter of the first embodiment of this invention includes an integrally formed container 12 having an open top portion 14, a body portion 16 with first and second ends, and a bottom portion 18. A bottle made of a flexible and elastic material, such as, for example, polyethylene is preferred because it is non-toxic and unbreakable.

The top portion 14 (FIGS. 1 and 2) includes a threaded open end to which may be secured a correspondingly threaded nipple retainer (not shown). A bellows shaped body portion 20 is formed integrally with the open threaded end and a pair of tubular handle forming walls 22 and 24 of the body portion 16.

Figure 2:
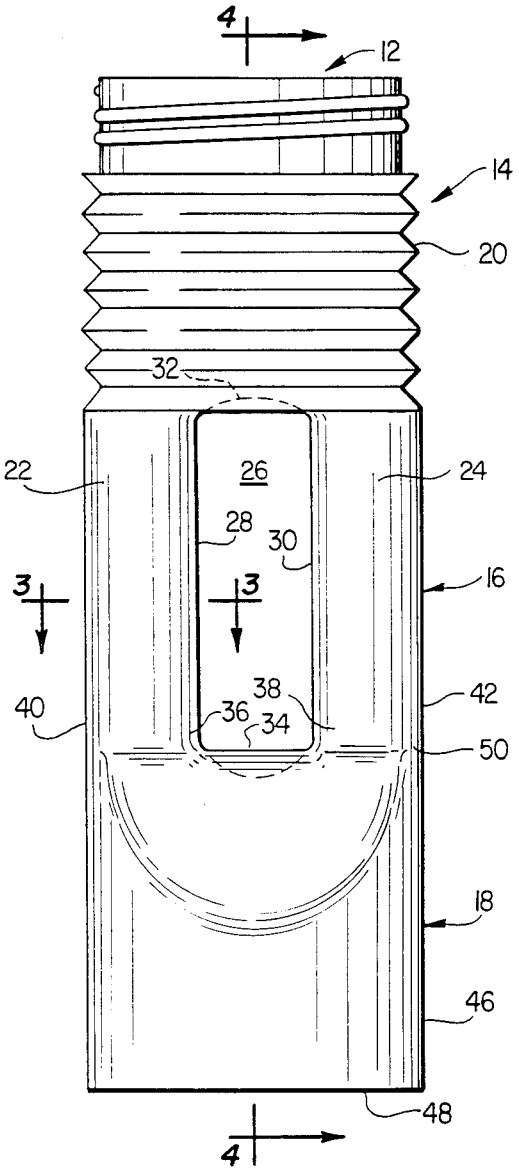
FIG. 2 is a front view of the baby bottle of FIG. 1.
Figure 3:
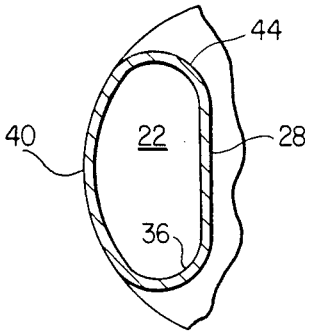
FIG. 3 is a half cross-sectional view of the baby bottle taken along line 3—3 of FIG. 2.

The pair of handle forming walls 22 and 24 of the body portion 16 form a centrally disposed aperture 26 (FIG. 2) through the bottle. The inner vertical sides 28 and 30 of the handle forming walls 22 and 24 have ends forming tapered ridge shaped first and second aperture closing ends 32 and 34 (FIGS. 1 and 2). The ridges are indicated by the phantom lines. The vertical sides 28 and 30 have first vertical edges integral with first edges of horizontally extending segmented circle ends 36 and 38. The second or opposing edges of the half circle ends 36 and 38 are integrally connected to vertically extending sides 40 and 42 of the handles 22 and 24 (FIG. 2). Sides 40 and 42 have a radius of curvature corresponding to that of the bottle top and bottom portions 14 and 18. The vertically extending sides 28 and 40 (FIG. 3) of handle 22 have ends opposite to the segmented circle end 36 integrally connected to ends of a second segmented circle end 44. Thus, segmented circle ends 36 and 44 are vertically disposed throughout the length of handle 22 and integrally joined opposite edges of vertical sides 28 and 40 to complete the tubular handle structure 22. While the opposing handle 24 has vertically extending handle sides 30 and 42 having vertical edges opposite to and integral with the corresponding edges of segmented circle end 38 and to corresponding edges of a segmented circle end (not shown). Thus, the handles 22 and 24 so constructed have identical cross-sections as shown in FIG. 3 for handle 22.

The bottom section 1 (FIGS. 1 and 2) has a body portion 46 having a bottom 48 formed integrally therewith and a top 50 formed integrally with the bottle's body section handles 22 and 24.

Figure 4:
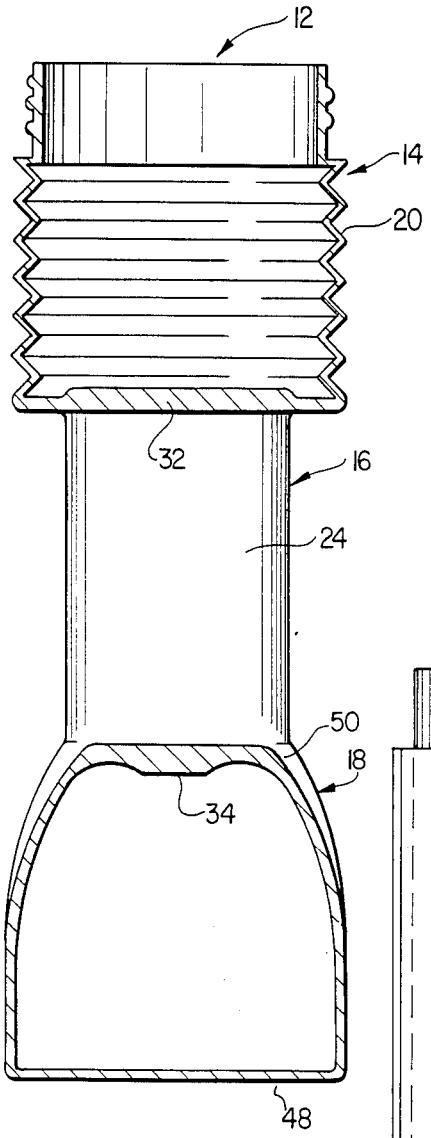
FIG. 4 is a cross-sectional view of one of the baby bottle handles taken along line 4—4 of FIG. 2.
Figure 5:
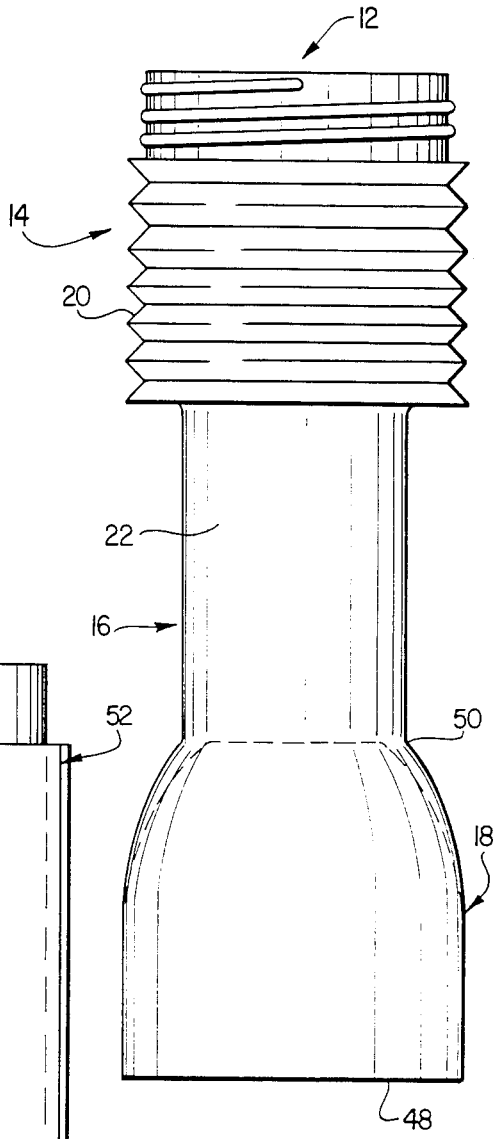
FIG. 5 is a side view of the baby bottle of FIG. 2.

Thus, a baby bottle of unitary construction is formed with a pair of tubular handles on opposing sides as shown in FIG. 2. The opposing sides normal to the handle sides form recessed guides to the handles as shown in FIG. 4.

The baby bottle constructed as described has centrally located tubular handles easily graspable by a baby for self-feeding. The tubular handles are in alignment with the bottle opening for readily receiving either a baby bottle cleaning brush for cleaning or a liner, or both. The bellows shaped top portion is compressible for removing air from a liner when used with a liner, and being at the top the bellows is readily accessible for cleaning.

Figure 6:
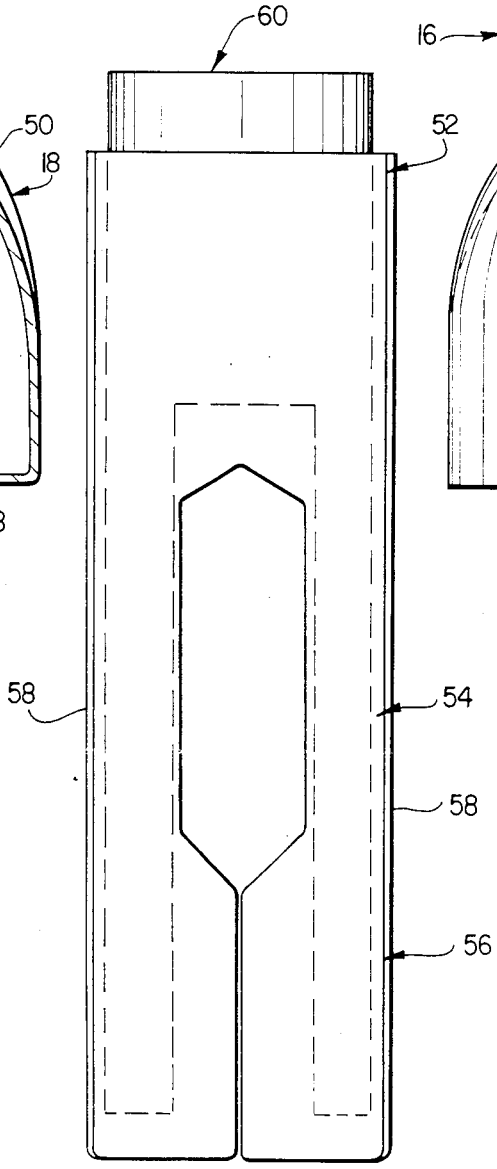
FIG. 6 is a plan view of a disposable liner with insert for use in the baby bottle of the first embodiment of the invention.

A disposable liner (FIG. 6), made of a resilient, non-toxic material such as a plastic, has a unitary top portion 52, a bifurcated body portion 54, and a bifurcated bottom portion 56. The top portion and bifurcated body portion correspond in shape to that of the top and body tubular portions of the bottle. While the bifurcated bottom portions of the liner are shaped to have abutting sides under the centrally disposed aperture to fill the bottle's bottom portion. For liner insertion, the liner is either formed with outwardly opposed stiff side seams 58 or is equipped with a bifurcated insert 60 (FIG. 6) of material such as, for example, cardboard or stiff plastic. The insert forms a ready means for inserting the liner into the baby bottle.

In operation, when the bottle is used with a liner, the bottle is cleaned and a liner, complete with insert, is removed from a sterile package and inserted into the bottle using the stiff insert. After insertion, the insert is removed the liner's opening fitted to the top of the bottle, and the bottle filled with the desired amount of liquid. Then a nipple (not shown) is attached to the bottle and the bottle compressed to force air from the liner. It will be appreciated that the top portion of the bottle is of a length permitting compression sufficient to accommodate bottle designed feeding volumes. With the air removed, the bottle has been prepared for feeding; after feeding the lining is disposed of.

When the bottle is used without the liner, the bottle is cleaned with a regular sized baby bottle cleaning brush, sterilized, filled with a liquid to the desired level and fitted with a nipple. The bottle is then ready for feeding.

In the following description of the second embodiment like reference numerals are used to designate structures identical to those of the first embodiment. Thus, in the second embodiment, the baby bottle 10 (FIG. 7) includes an integrally formed container 12 having an open top portion 14, a body portion 16, and a bottom portion 18.

The top portion 14 includes a threaded open end for receiving a correspondingly threaded nipple retainer (not shown), and a bellows shaped tubular body surface portion 20 formed integrally with the open threaded end and the top end of the body portion 16.

Figure 9:
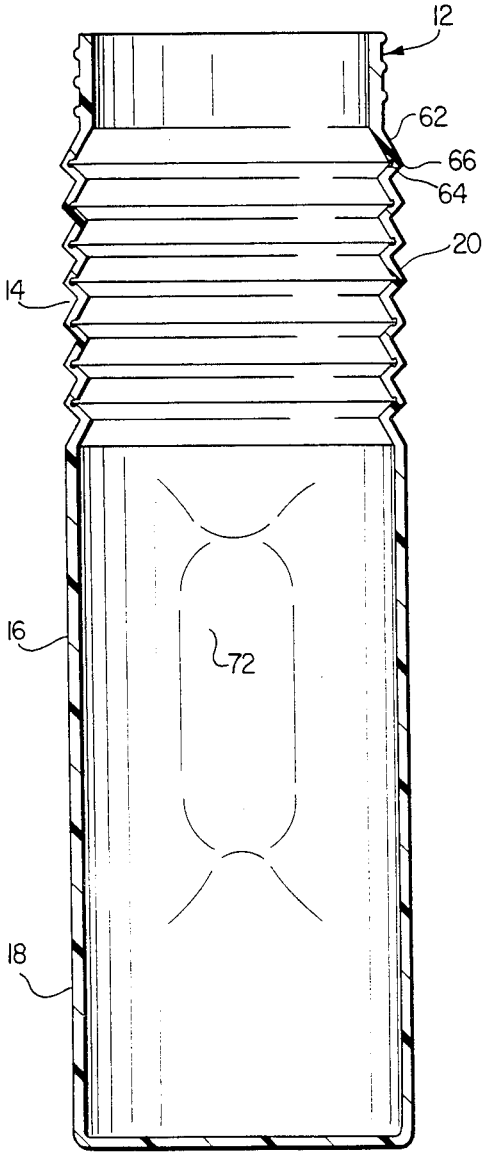
FIG. 9 is a cross-sectional view of the baby bottle taken along line 9—9 of FIG. 7.
Figure 10:
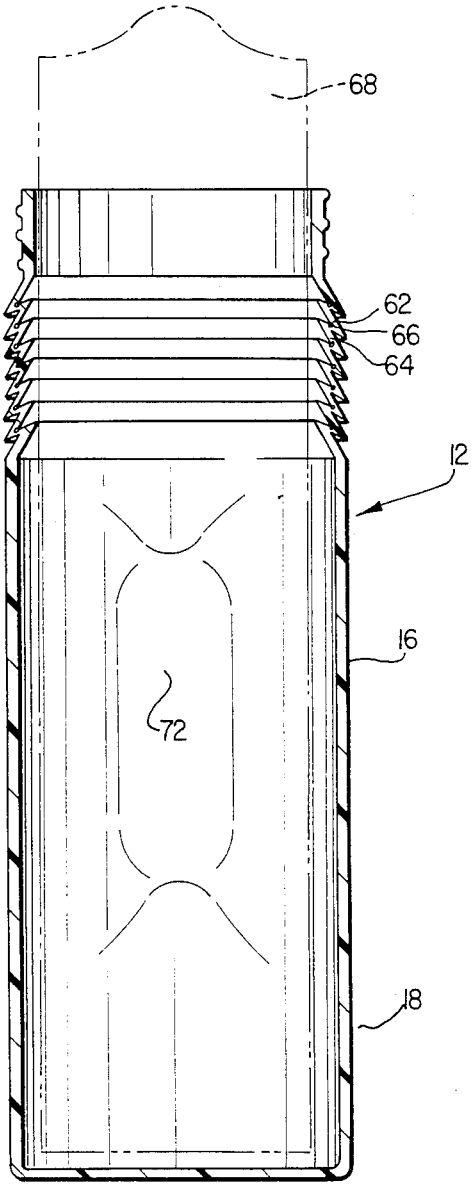
FIG. 10 is a cross-sectional view of the baby bottle as shown in FIG. 9 with the bellows collapsed and a liner inserted.
Figure 11:
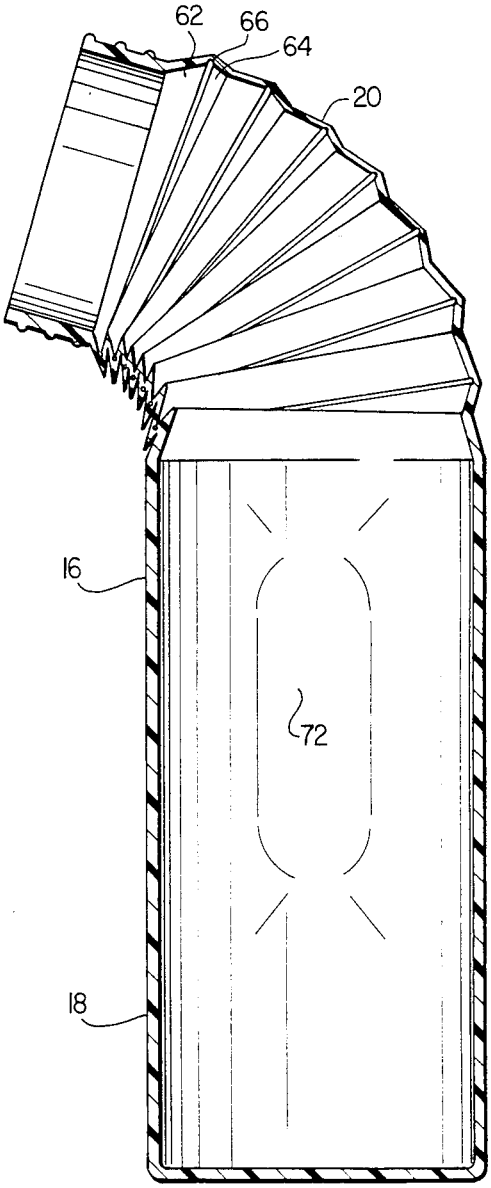
FIG. 11 is a cross-sectional view of the baby bottle as shown in FIG. 9 with the bellows locked in a bent position.

Each segment of the bellows 20 (FIG. 9) is formed by two sloping members 62 and 64 integrally interconnected by a connecting member 66. The slope of member 62 is comparatively gentle, while the slope of member 64 is comparatively steep. The slopes are determined by the lengths of the members 62 and 64. The connecting member 66 of the sloping members has a thickness less than the thickness of the sloping members. Thus, when the bellows 20 is compressed to a desired length for removing air from the container 12 or a liner 68 (FIG. 10) mounted in the container, the steeper and shorter slope member 64 folds and locks beneath the gentle sloping member 62 to retain the compressed position of the bellows. The bellows 20 can also be locked in a bent over on one side position (FIG. 11) to facilitate use in feeding a baby.

The container can be provided with markings indicating volumes for selection by bellows compression selection. Also, when the container 12 is used with a liner 68, the desired volume, for example 4, 6, 8, or 10 ounces can be indicated on a liner. The liner measurement markers are positioned with respect to the surface shape of the container for accurately measuring the volume of liquid contained. The liner is then folded over the open top of the container at the desired volume marker, filled with the desired quantity of liquid, and retained by the nipple retainer when attached. Thereafter, the bellows is compressed to remove any air trapped in the liner and automatically locks in the compressed position to prevent air reentry by unfolding.

Figure 7:
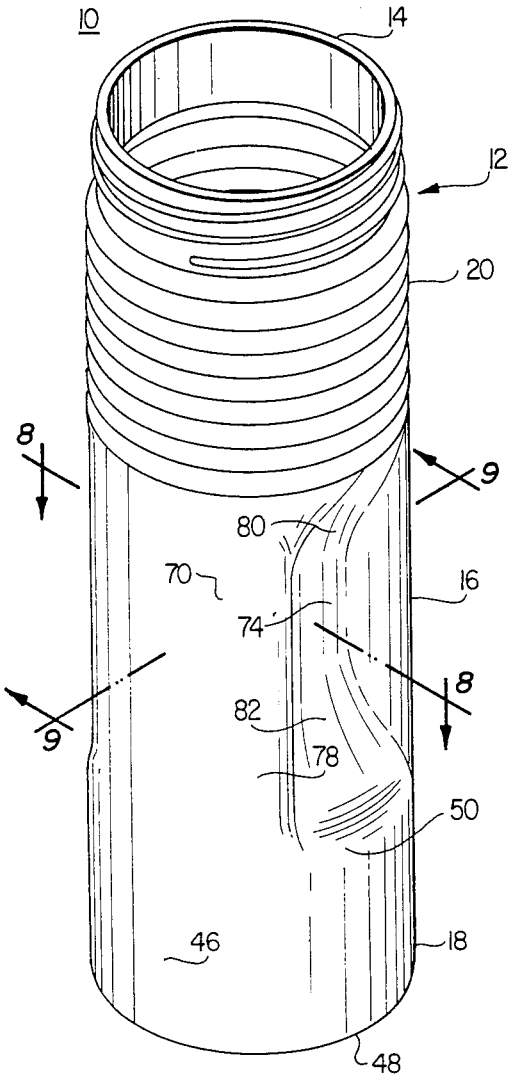
FIG. 7 is an isometric view of a baby bottle constituting a second embodiment of the invention.
Figure 8:
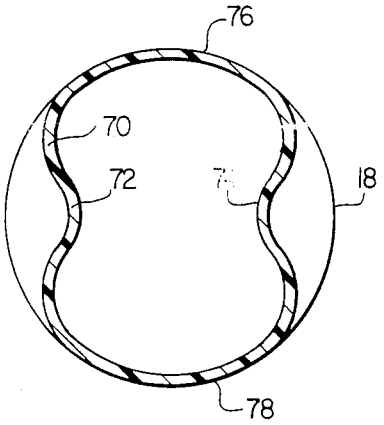
FIG. 8 is a cross-sectional view of the baby bottle taken along line 8—8 of FIG. 7.

The body portion 16 (FIGS. 7 and 8) has a tubular body surface 70, preferably cylindrical, having a pair of opposing recesses 72 and 74 formed therein. The recesses 72 and 74 are of a size sufficient to form portions of body surface 70 adjacent to the recesses into a pair of handles 76 and 78 having a size sufficient for a baby's hands to grasp for self-feeding. The recesses 72 and 74 have outwardly flared top and bottom end zones 80 and 82 for guiding an infant's fingers into the recesses for grasping the handles. The flared end zones of the recesses merge smoothly into the outer surfaces of the top and bottom portions 14 and 18 of the container 12. The remaining portions of the wall 70 are shaped to correspond, respectively, to the adjoining shape of the top and bottom portions 14 and 18 of the container as shown in FIG. 7. Thus, the body portion 16 of the container 12 has a horizontal cross-section (FIG. 8) simulating a hollow dumbbell which provides a single passage through the body section for facilitating bottle cleaning and sterilization and insertion of a liner when used.

The bottom section 18 (FIG. 7) has a vertical tubular surface 46 having a bottom 48 formed integrally therewith and a top 50 formed integrally with the body section 16 of the bottle.

Thus, the baby bottle of the second embodiment provides a self-locking bellows means for removing air from the baby bottle, as does the first embodiment baby bottle. The means is located in the top portion of the baby bottle where it is readily available for cleaning and sterilizing. The baby bottle also has baby size handles suitably located (in the body section of the baby bottle for balance) to facilitate use by an infant for self-feeding.

The handle means, unlike the tubular handle means of the first embodiment which by its aperture provides enhanced baby self-feed capability, has no aperture, but has as tradeoffs a reduced surface area to be cleaned and sterilized and a single passage to facilitate access to the surface areas of the body and bottom portions of the bottle for cleaning.

A further tradeoff exists in that the single passage structure of the body portion of the second embodiment simplifies liner fabrication by eliminating the bifurcations of the liner for the first embodiment. The single passage facilitates both insertion of the liner into the bottle and filling the liner.

Although more than a single embodiment of this invention has been described, it will be apparent to a person skilled in the art that various modifications to the details of construction shown and described may be made without departing from the scope of this invention.

What is claimed is:

1. A liner for a baby bottle having an open top, a pair of spaced tubular members and a closed bottom comprising:

a top portion and bifurcated body and bottom portions depending from the top portion, said top portion and bifurcated body portion having a shape corresponding to the shapes of the bottle top and pair of tubular members, and said bifurcated bottom portions having a combined shape corresponding to the shape of the bottle bottom.

2. A liner according to claim 1 wherein said liner further includes a removable insertion means, said liner responsive to the insertion means for positioning the liner portions corresponding to the shape of the bottle portions into the corresponding bottle portions.

3. A liner according to claim 2 wherein the removable insertion means includes a stiff member having a body portion and bifurcated portions having dimensions of sufficient size for positioning the liner bifurcated portions in the bottle's bottom and pair of tubular members and for positioning the liner top portion in the bottle's top for attachment to the bottle open top.

4. A liner for a baby bottle according to claim 1 wherein opposing seams are formed along the outer edges of the liner top portion and bifurcated body and bottom portions, said seams having a stiffness sufficient for inserting the liner into a baby bottle having a shape corresponding to that of the liner.

5. A baby bottle comprising: a container having an open top, a closed bottom, a plurality of tubular shaped handles interconnecting to the open top and closed bottom, said plurality of tubular shaped handles being in vertical alignment with the open top of said container for facilitating the cleaning of the bottle when used without a liner and for facilitating the insertion of a liner when used with a liner, and means forming a bellows type surface whereby when the bottle is used with or without a liner, the bottle is responsive to compression of the bellows type surface for air removal.

6. A baby bottle according to claim 5 wherein the bellows type surface is located adjacent to the open top for facilitating cleaning.

7. A baby bottle comprising: a container means including a top portion having an open end for connection to a nipple means; a closed bottom portion; and a pair of spaced tubular means operatively connecting the top portion to the bottom portion, said pair of spaced tubular means being in vertical alignment with the open end of the top portion and the bottom portion whereby the cleaning of the bottle is facilitated and the insertion of a liner is facilitated, and a removable liner having a top portion corresponding to the bottle top portion and a bifurcated portion, the bifurcated portion extending from the top portion through the bottle tubular means and into the bottle bottom portion.

8. A baby bottle according to claim 7 wherein the container means includes means for forming a bellows surface, said liner responsive to compression of the bellows surface for ejecting air from the liner.

9. A baby bottle comprising a container having top, body, and bottom portions, the top and bottom portions formed integrally with the body portion; said top portion including an open top and surface means forming a collapsible, self locking bellows adjacent to the top for removing air from the container; said body portion including a tubular surface corresponding to the surface means of the top portion, said tubular surface having first and second opposing recesses coacting with the adjacent portions of the tubular surface for forming first and second opposing handles of a size sufficient for grasping by an infant for self-feeding, said first and second opposing recesses and said first and second handles coacting with the first and second recesses for forming an open passage between the top and bottom portions of the container for providing ready access to the bottom portion for facilitating cleaning and sterilization during use with or without a liner and for facilitating liner insertion when used with a liner, and said bottom portion including a surface means having a bottom formed integrally therewith for closing the bottom portion of the container, whereby the container, or a liner inserted in the container may be filled with a desired amount of liquid, the top portion of the container collapsed to remove air from the container or liner above the liquid and at least one of the handles can be grasped by an infant for self-feeding.

10. A baby bottle according to claim 9 wherein the surface means forming a collapsible, self locking bellows includes a plurality of like interconnecting bellows segments, each segment including first and second members and interconnecting means integrally formed between ends thereof for interconnecting the first and second members, the first member having a length sufficiently greater than that of the second member and the interconnecting means having a thickness sufficiently less than the thickness of the first and second segment members whereby when the bellows is compressed the second member folds beneath the first member and locks in that position.

11. A baby bottle according to claim 9 wherein the first and second opposing recesses of the surface of the body portion include finger guiding means for guiding the fingers of an infant into the recesses for grasping at least one of the first and second handles for self-feeding.

12. A baby bottle according to claim 11 wherein the finger guiding means includes first and second outwardly extending flared end zones integrally formed with the recesses and surfaces of the top and bottom portions of the container.

13. A baby bottle according to claim 9 wherein the collapsible, self locking bellows is a bendable bellows for facilitating baby feeding.

* * * * *

UNITED STATES PATENT AND TRADEMARK OFFICE

CERTIFICATE OF CORRECTION

PATENT NO. : 4,813,556

DATED : March 21, 1989

INVENTOR(S) : Gary D. Lawrence

It is certified that error appears in the above-identified patent and that said Letters Patent is hereby corrected as shown below:

Column 1, line 19, "Campbel" should be --Campbell--;

Column 2, line 41, "entrally" should be --centrally--;

Column 3, line 57, "1" should be --18--; and

Column 4, line 25, should be comma after removed.

Signed and Sealed this

Twenty-sixth Day of September, 1989

*Attest:*

DONALD J. QUIGG

*Attesting Officer*

*Commissioner of Patents and Trademarks*